US007237678B2

(12) United States Patent
Lo Duca

(10) Patent No.: US 7,237,678 B2
(45) Date of Patent: Jul. 3, 2007

(54) DISPLAY BOX WITH ELEMENTS PROTECTING AGAINST THE ROTATION AND MOVEMENT OF A CONTAINER INSERTED INTO THE BOX

(75) Inventor: Carmelo Lo Duca, Milan (IT)

(73) Assignee: GI. BI. EFFE S.r.l., Milan (IT)

( * ) Notice: Subject to any disclaimer, the term of this patent is extended or adjusted under 35 U.S.C. 154(b) by 305 days.

(21) Appl. No.: 10/830,045

(22) Filed: Apr. 23, 2004

(65) Prior Publication Data

US 2004/0262195 A1 Dec. 30, 2004

(30) Foreign Application Priority Data

May 19, 2003 (IT) ..... MI2003A0986

(51) Int. Cl.
*B65D 5/50* (2006.01)

(52) U.S. Cl. ..... 206/756; 206/781; 206/446

(58) Field of Classification Search ..... 206/315.9, 206/426, 446, 756, 764, 765, 783, 781, 776; 229/131, 143, 150, 154, 937
See application file for complete search history.

(56) References Cited

U.S. PATENT DOCUMENTS 934,266 A * 9/1909 Barlett ..... 229/4.5
3,368,735 A * 2/1968 Levi ..... 206/424
5,029,709 A * 7/1991 Faulstick ..... 206/455
5,540,330 A 7/1996 Lo Duca
2002/0036150 A1 3/2002 Knaack et al.

FOREIGN PATENT DOCUMENTS

| | | |
|---|---|---|
| DE | 94 19 312 | 3/1995 |
| DE | 200 17 067 | 2/2001 |
| EP | 0 642 977 A1 | 3/1995 |
| EP | 0 699 588 | 3/1996 |
| EP | 0 761 550 A1 | 3/1997 |
| EP | 1 193 182 | 4/2002 |

* cited by examiner

*Primary Examiner*—David T. Fidei
(74) *Attorney, Agent, or Firm*—Oblon, Spivak, McClelland, Maier & Neustadt, P.C.

(57) ABSTRACT

Display box for housing a cylindrical container with a side portion thereof visible through a window provided in at least one of the side walls of the box, including elements which interfere with the container, to lock the container, protect the container within the box, and to prevent the container from accidentally rotating about an axis.

2 Claims, 6 Drawing Sheets

DISPLAY BOX WITH ELEMENTS PROTECTING AGAINST THE ROTATION AND MOVEMENT OF A CONTAINER INSERTED INTO THE BOX

FIELD OF THE INVENTION

The present invention relates to a display box, i.e. a box intended to house, protect and retain a cylindrical container with a portion of its lateral surface positioned in front of a window provided in the box in such a manner that trademarks, writings, descriptions and the like present on said lateral surface portion of the container are visible through said window.

BACKGROUND OF THE INVENTION

Many types of display boxes are known provided with elements which retain and protect a container housed therein such that the base of the container is kept raised from the base of the box to protect it from possible impacts while transporting or storing the boxes with the containers therein or while moving them from one place to another. A box of this type is illustrated, for example, in EP-B-0642977 and in the corresponding U.S. Pat. No. 5,540,330; it is formed from a single piece of punched and crease-lined cardboard having projecting flaps at one end, these flaps being automatically folded about themselves (on shaping the box) to form supports which are only partly glued onto the side walls of the box and perform the effective function of keeping the container housed in the box raised and spaced from the adjacent base of the box.

EP-A-0761550 describes a display box also formed from a single piece of punched and crease-lined cardboard which differs from the box claimed in the aforesaid patents by the fact that one of the flaps projecting from an end of the cardboard sheet is very long and, in addition to forming a portion for supporting the container base (by keeping it raised in front of a window provided in the side wall of the box), extends (while remaining adhering to a side wall of the box) beyond the opposite end of the box and is partly glued to a flap projecting from said opposite end: in this manner, when the cardboard sheet is folded to form the finished box, the said very long flap forms two separate supports, one for the lower end of the container and the other for the upper end of the container, which is hence securely retained in the box and is protected against those impacts which may be transmitted to the two lids or ends of the box.

The main drawback of known display boxes is that nothing effectively prevents the containers from rotating (as a result of the handling and transport to which the finished boxes are subjected) about their longitudinal axis, so that any portion of the cylindrical surface of the containers can appear visible through the windows provided in the box, rather than only and always that portion carrying trademarks, writings, labels or the like which are required to remain positioned in front of the windows provided in the boxes.

SUMMARY OF THE INVENTION

The main object of the present invention is therefore to provide a display box in which a substantially cylindrical container can be enclosed and protected against impacts both against its base and against its top and, in particular, in which the container is substantially prevented from rotating about its longitudinal axis.

Another object is to provide a box having the aforesaid functional characteristics, while being easily and economically obtainable from a single piece of punched, crease-lined and glued cardboard.

These and further objects are attained by a box comprising four side walls having lower ends and, respectively, upper ends from which there project a bottom lid and respectively a top lid, and elongate flaps in which creasing lines, cuts or holes are provided along which said flaps are folded so that at least one portion thereof is in contact with and glued onto the inner surface of the side wall from which each flap projects, at least one of the lower flaps forming for the container a support which is spaced from the bottom lid of the box, while the upper flaps form, for the top of the container, a pressing structure which is spaced from the top lid of the box, characterised in that each of the upper flaps is folded and partly glued onto itself such as to lie substantially flat and coplanar with that side wall of the box from which it projects when said flap is in its extended position with a portion thereof projecting from the upper end of the box but, by simply turning the flap over towards the box interior, to undergo deformation and to automatically form a surface arranged to rest and press on the top of a container inserted into the box, causing the substantially semiarch-shaped edge of an aperture provided in a portion of said flap to simultaneously project towards the interior of the box, such that the cylindrical upper lateral surface of a container inserted into the box is securely retained laterally by said semiarch-shaped edges of the upper flaps and at the same time is pressed by said flaps towards and against the support for the container base.

Preferably, each of said upper flaps is divided into eight separate consecutive flap portions separated from each other by parallel folding lines, in the first two flap portions closest to that side wall of the box from which they project there being provided a large profiled hole extending on both sides of the folding line which separates said first two flap portions from each other, an elongate aperture being provided in the fourth and fifth flap portion on one and on the other side of the folding line which separates them, said aperture being bounded by said substantially semiarch-shaped edge which is provided in said fifth flap portion.

BRIEF DESCRIPTION OF THE DRAWINGS

One embodiment of the box is shown by way of non-limiting example in the accompanying drawings, in which.

Figure 6:
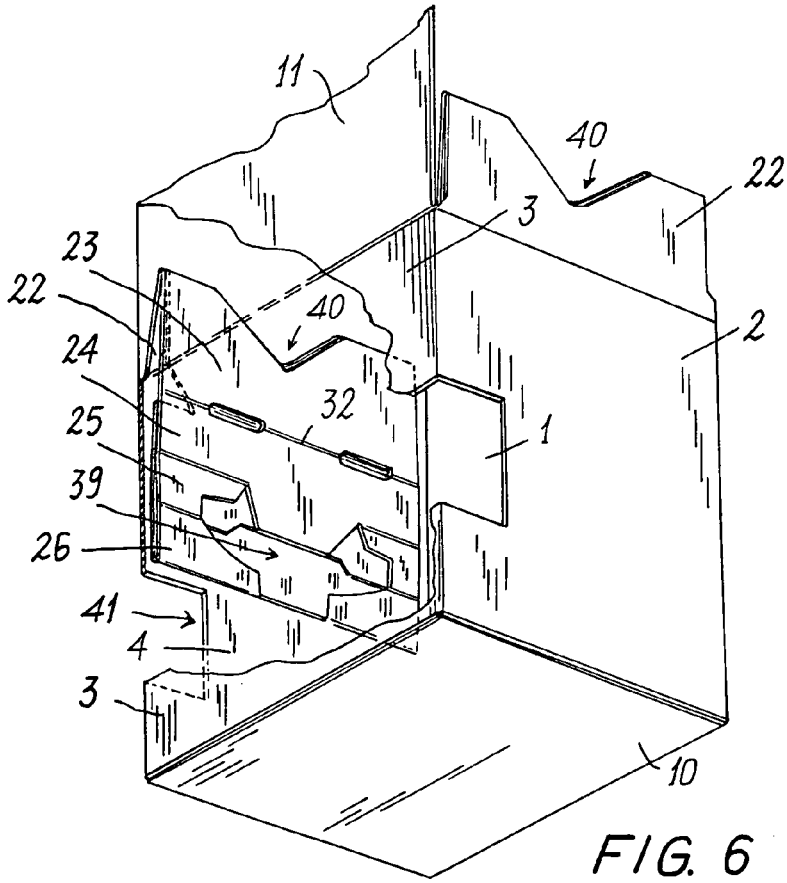
Figure 7:
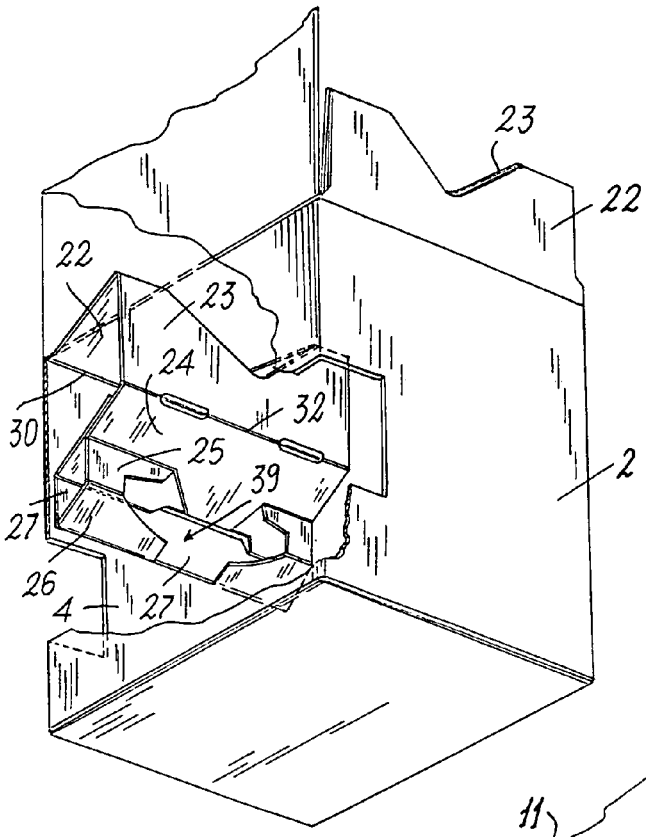
Figure 8:
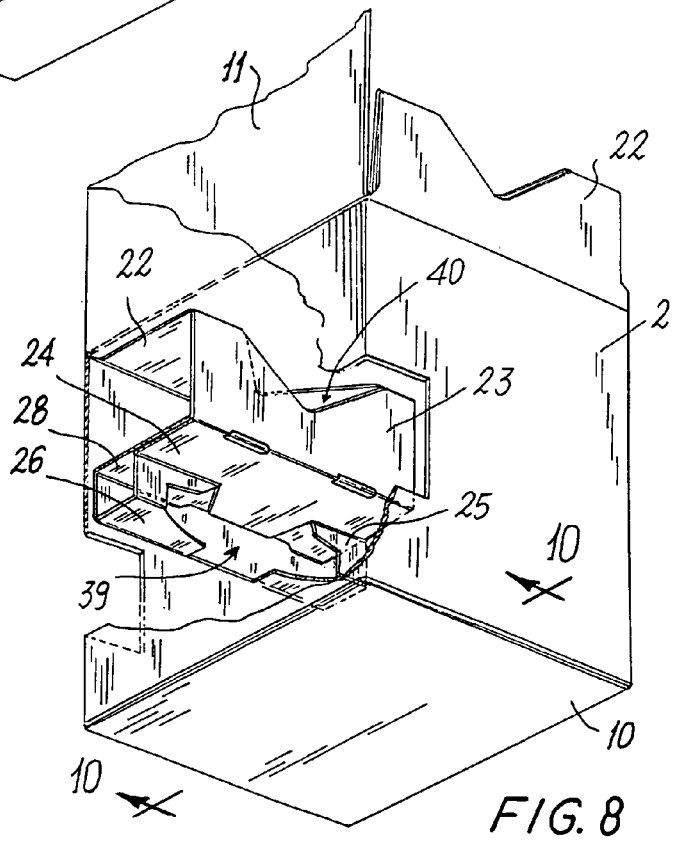
Figure 9:
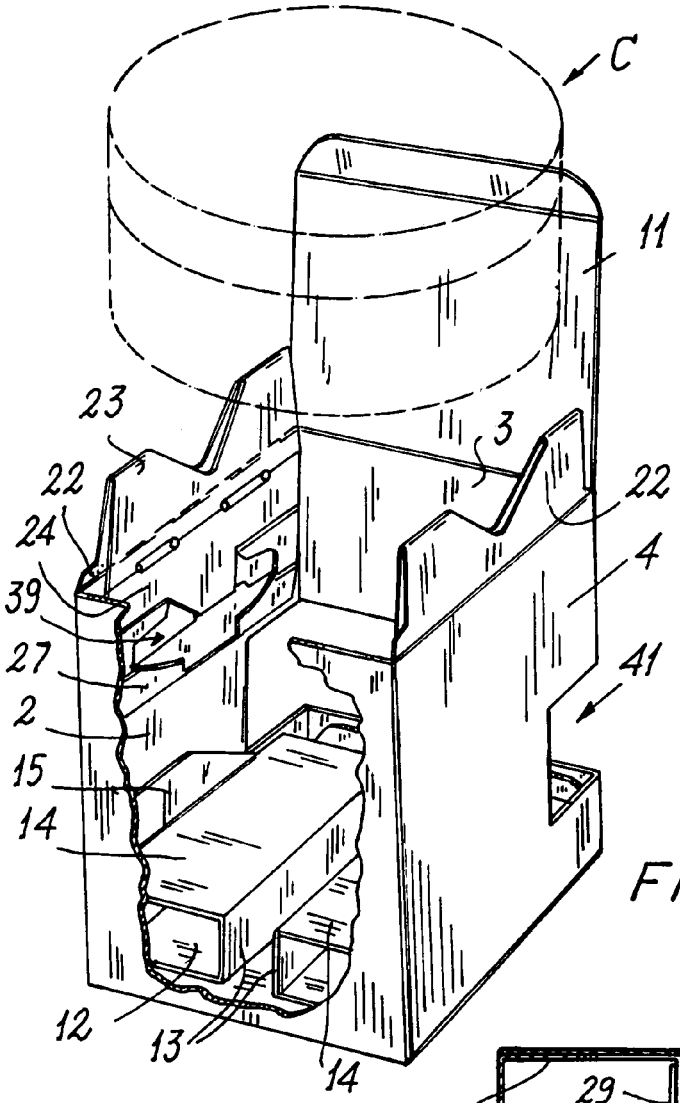
Figure 10:
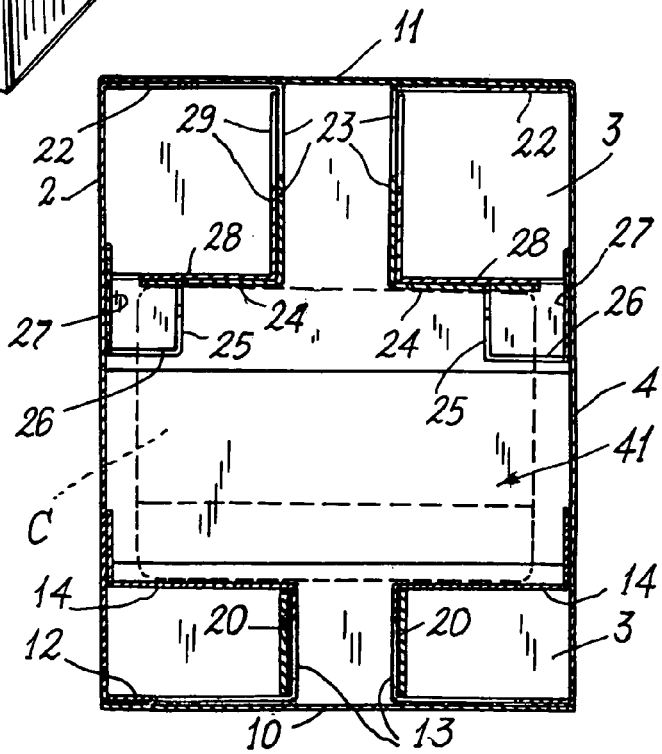

FIGS. from 2 to 5 show the same cardboard sheet in its various successive stages of folding and gluing;

FIGS. 6, 7 and 8 are perspective views of the finished box, with a portion of the side wall of the box removed to show the attitude which one of the upper flaps of the box assumes as the flap is being folded from its extended flat position to its folded position in the interior of the box;

FIG. 9 is a schematic perspective view of the box, with a portion of its side wall omitted, in the attitude which it assumes at the moment in which a cylindrical container is about to be inserted into the box; and FIG. 10 is a cross-section through the box on the line 10—10 of FIG. 8 but assuming that the box has been closed after a container, the profile of which is represented simply by dashed lines, has been inserted into it.

DETAILED DESCRIPTION OF THE INVENTION

To understand the structure of the cardboard sheet and the method of forming the display box obtainable therefrom, reference is firstly made to Figures from 1 to 5 from which it can be seen that the punched, crease-lined and knurled cardboard sheet (shown in plan view on the side forming its inner surface in FIG. 1) comprises four side walls 1–4 and a tab 5 which are separated from each other by parallel creasing lines 6–9. From the lower end of the wall 1 and from the upper end of the wall 3 there project two panels 10, 11 intended to form the lower and respectively the upper lid of the box in traditional manner.

From the lower ends of the side walls 2, 4 there project respective elongate flaps (identical in the illustrated embodiment) each divided into separate flap portions 12–15 by folding lines or creasing lines 17–19, they being separated from the respective side walls 2, 4 by creasing lines 16: the creasing lines 16–19 are mutually parallel and are perpendicular to the creasing lines 6–9. In both the flap portions 12 there is provided a cut bounding a tab 20 which is separated from the adjacent flap portions 13 by a knurling 21 which incises the folding line 17, its purpose being to facilitate the turning of the tab 20 onto the adjacent flap portion 13, as explained hereinafter.

From the upper (with respect to the drawing) ends of each of the walls 2 and 4 there projects an elongate flap (identical) divided into flap portions 22–29 by folding lines 31–37 and separated from the respective wall 2, 4 by a creasing line 30, these folding and creasing lines 30 being parallel to each other and perpendicular to the creasing lines 6–9.

Figure 1:
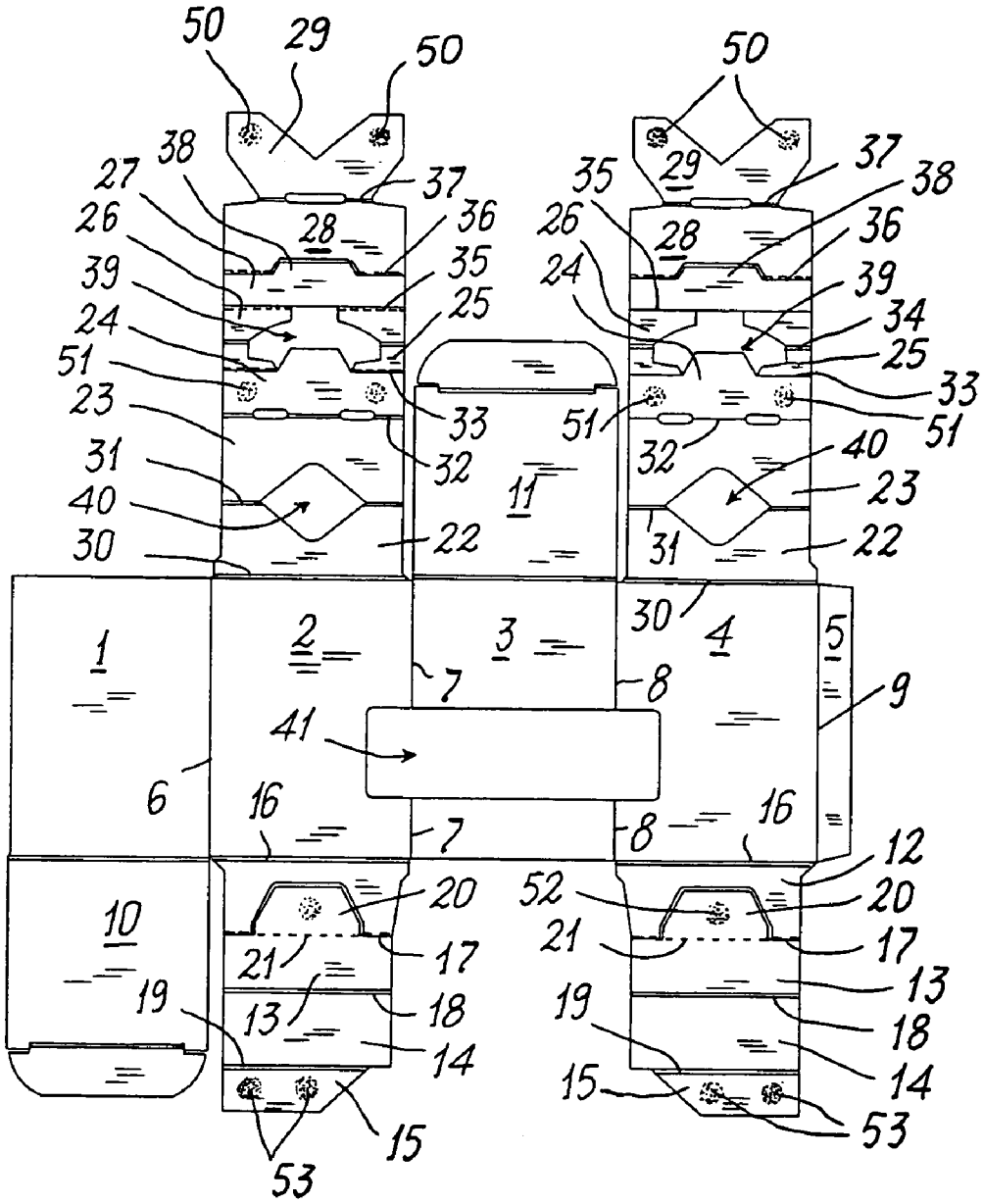
FIG. 1 is a spread-out plan view, seen from that surface thereof intended to remain inside the box, of a punched, knurled and crease-lined cardboard sheet.

In particular from FIG. 1 it can be seen that the folding line 36 is interrupted in its central part by a thin profiled cut defining a tooth 38 which projects from the flap portion 27, and that in the flap portions 25, 26 a profiled hole 39 is provided, the upwardly (with respect to FIG. 1) facing free edge of which is shaped substantially as a semiarch (interrupted at its centre by an undercut which extends as far as the folding line 35), along the folding lines 32, 37 there being provided elongate holes the purpose of which is to facilitate the folding of the flap portions about said folding lines, a large profiled hole 40 being provided in the flap portions 22, 23 which interrupts the folding line 31 and is of substantially rhomboidal shape.

Finally, it can be seen that in the walls 2–4 there is provided a large elongate hole 41 intended to form the window through which the writings reproduced on the cylindrical outer surface of the container to be housed and retained in the made-up box, will be visible.

Figure 2:
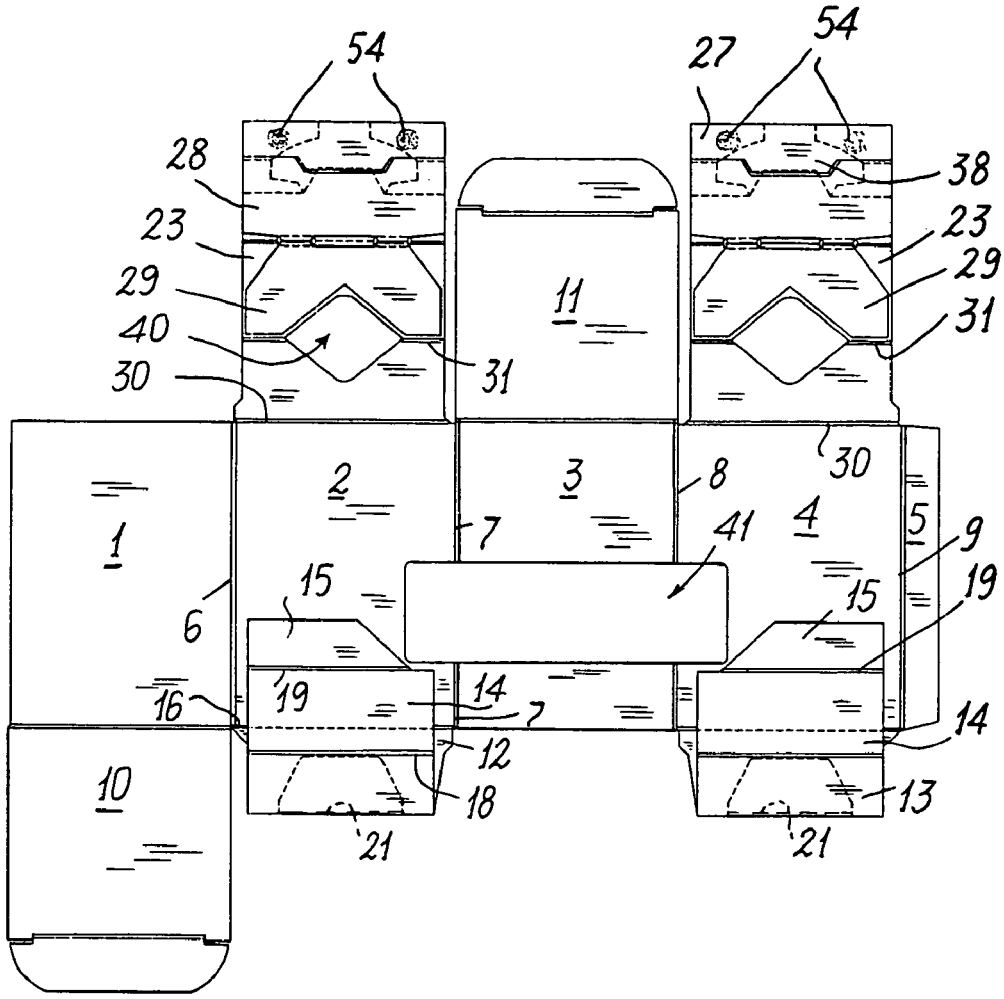

Starting with the cardboard sheet of FIG. 1, glue spots 50, 51 are firstly applied to the flap portions 29, 24 and glue spots 52, 53 to the tabs 20 and to the lower flap portions 15. Each upper flap is then turned over about the folding line 35 to fix the flap portion 28 onto the flap portion 24 and the flap portion 29 onto the flap portion 23; then the lower flaps are turned over about the folding lines 17, 21 to fix the tab 20 onto the flap portion 13 and the flap portion 15 onto the respective wall 2, 4, as can be seen from FIG. 2 from which it can be seen that the end edge of the flap portions 29 presents an undercut, in order to be aligned with the underlying portion of the free edge bounding the large profiled hole 40, which hence remains free (FIG. 2).

Figure 3:
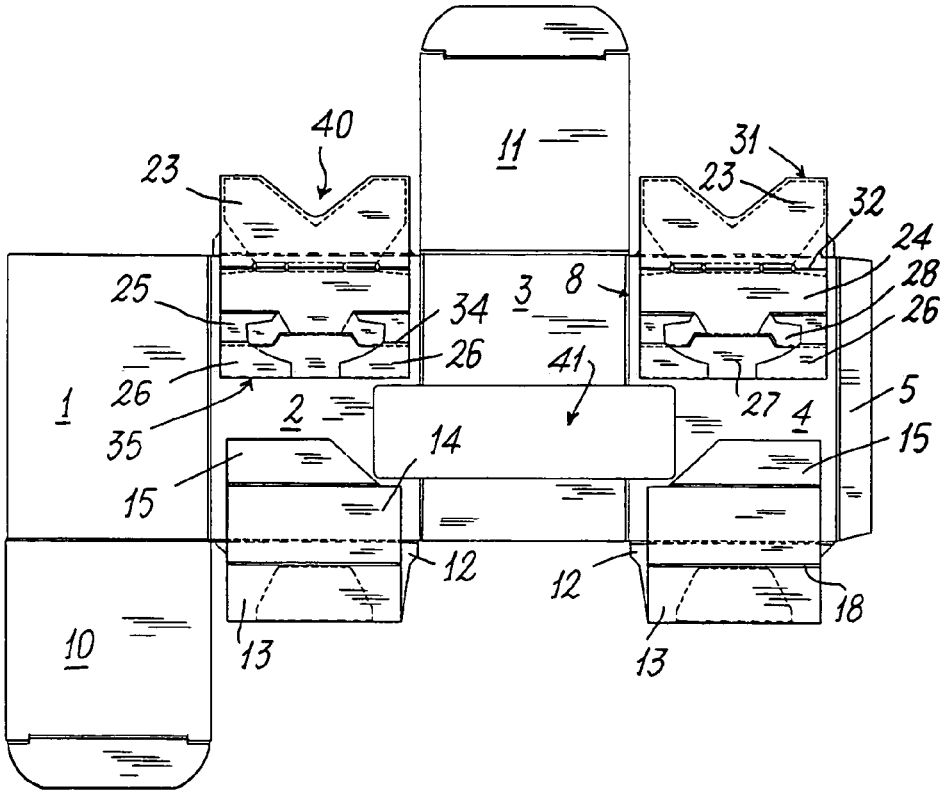

Glue spots 54 are then applied to the surface of the portion 27 of each upwardly facing upper flap (FIG. 2), then each said flap is turned over about the folding line 31 so that the flap portion 27 adheres (and is fixed by the glue) to the inner surface (facing upwards in FIGS. 1–4) of the respective side wall 2, 4, as seen in FIG. 3: under these conditions, each of the two upper flaps is turned over onto itself and assumes a flattened form intuitable from the aforestated and as can be clearly seen from FIGS. 6 and 9 which will be described hereinafter.

Figure 4:
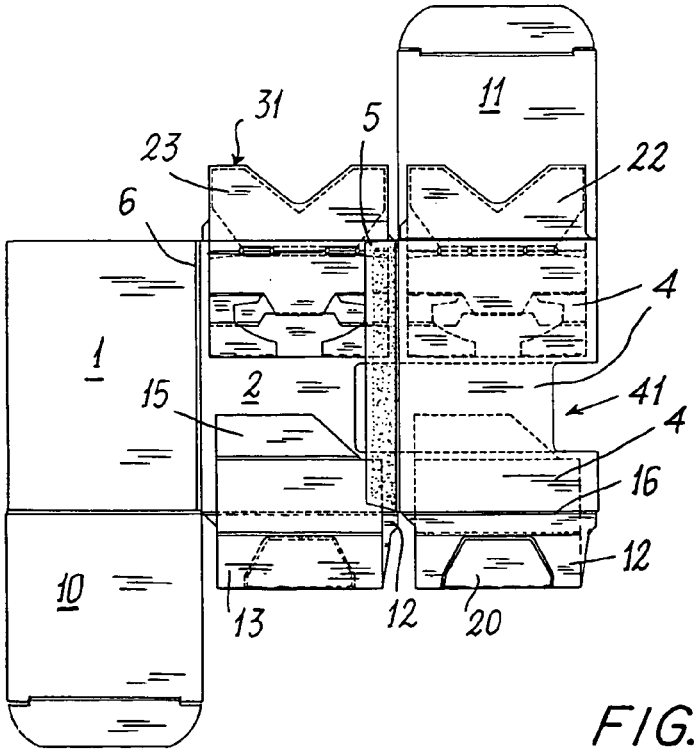

At this point the cardboard sheet is folded about the creasing line 8, to superpose the already turned-over upper flaps on the side wall 3 of the box (FIG. 4).

Figure 5:
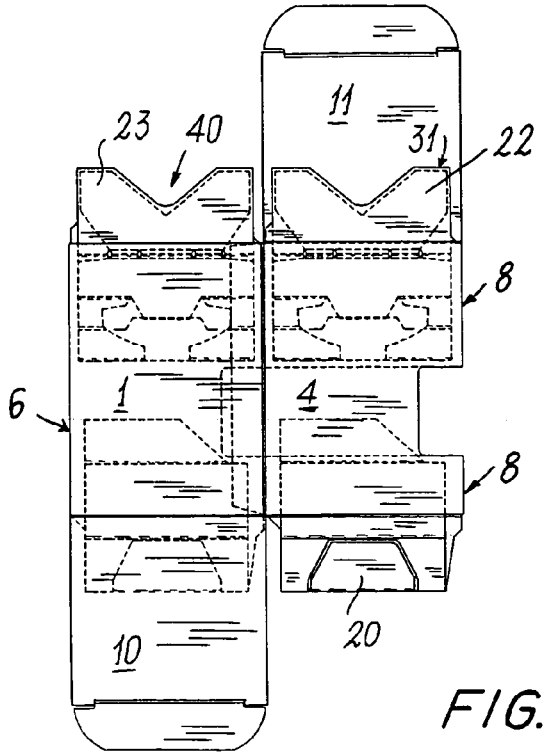

A strip of glue (represented by dots) is then applied to the upperly facing surface of the tab 5 (FIG. 4), then the side wall 1 of the box is turned over by rotating it about the creasing line 6 and superposing it on the already folded upper flaps resting on the wall 2, in order to glue the free longitudinal edge of said wall 1 to the tab 5 (FIG. 5).

The task of the cardboard processing firm which has produced the box is hence terminated, and packs of flattened boxes are dispatched to the box user firms which, using automatic machines of known type and common use, firstly press the creasing line 6 towards the creasing line 8 (hence causing the box to assume a tubular shape with a square or rectangular cross-section), then rotate the lower flaps of the box towards the box interior and finally close the bottom lid: the box hence assumes the appearance shown in perspective view seen frontally from below (with part of the side walls of the box removed to allow a clear view of its interior structure) in FIG. 6.

In FIG. 6, in which the lower part of the box possesses its final shape (whereas its upper end is open), i.e. the shape which it must have to be ready for inserting a cylindrical container (shown schematically in FIGS. 9 and 10 by the letter C) into it, as clearly represented in FIG. 9 in which for clarity the box is drawn as it appears if seen rotated through 180° about its longitudinal axis with respect to Figures from 6 to 8.

Starting from the conditions of FIGS. 6 and 9 and assuming that the container c has already been inserted into the box (the container is not however shown in Figures from 6 to 8), the upper flaps are folded towards the box interior, passing through the intermediate position of FIG. 7 (in which only the left upper flap is shown partly folded into the box), to reach the final position of FIG. 8 (where the flap portion 24 assumes an attitude parallel both to the parts 14 of the lower flaps and to the two lids 10, 11 when in their closed position) in which the container C (see FIG. 10) rests on the horizontal parts 14 and is supported by the two vertical parts 13 and by the tabs 20 glued thereto and deriving from the lower flaps of the box, the container being permanently urged downwards by the parts 24 of the upper flaps and being laterally retained, positioned and locked 25 securely by the semiarch-shaped free edges of the holes 39 in the said upper flaps, said shaped edges being pressed against the cylindrical surfaces of the upper part of the container C which is securely retained by said shaped edges by friction so that the container cannot rotate freely about its axis.

It follows that as the window 41 and the upper and lower edges of the box are shaped and dimensioned such that in front of and through the window 41 there is positioned and visible that portion of the container cylindrical surface carrying the trademarks or writings which are to remain always easily visible by the purchaser of the products enclosed in the container C, once the containers have been correctly positioned in the boxes their attitude cannot be accidentally changed during box handling and storage.

An important characteristic of the described box is the considerable ease with which the container C can be inserted, correctly positioned and locked inside the box.

To understand this, reference will be made to FIG. 9 in which the upper flaps and the lid 11 are completely aligned with those side walls of the box from which they project: the container C can be rested on the portions 14 of the lower flaps which are flat and spaced from the bottom lid 10.

After the container C has been inserted into the box, when the upper flaps are rotated about the folding line 30 to pass in succession through the intermediate position of FIG. 7 to the completely turned-over position of FIGS. 8 and 10, the shaped edges of the apertures 39 firstly move downwards and at the same time towards the centre of the box to interfere with the cylindrical surface of the container C and hence position it correctly in the centre of the box, and then securely lock it in this position in which it is finally retained by the portions 24, 28 of the upper flaps which at the same time have been lowered to press on the top of the container and urge it and lock it onto the portions 13, 14, 20 of the lower flaps (FIG. 10).

The container C is hence automatically protected against impacts received both against the top and against the side walls of the box, and in addition the container cannot rotate accidentally about its axis.

I claim:

1. A display box for housing and retaining cylindrical containers with a portion of their lateral surface visible through a window provided in the box, comprising four side walls having lower ends and, respectively, upper ends from which there project a bottom lid and respectively a top lid, and upper and lower elongate flaps in which creasing lines are provided along which said upper and lower elongate flaps are folded with at least one portion thereof being in contact with and being glued onto the inner surface of the side wall from which each respective upper and lower flap projects, at least one of the lower elongate flags forming for the container a support which is spaced from the bottom lid of the box, and wherein the upper elongate flaps are configured to form, for the top of the container, a pressing structure which is spaced from the top lid of the box, wherein each of the upper elongate flaps is configured to be folded and partly glued onto itself such as to lie substantially flat and coplanar with that side wall of the box from which it projects when said upper elongate flap is in its extended position with a portion thereof projecting from the upper end of the box but, by simply turning the upper elongate flap over towards the box interior, to undergo deformation and to automatically form a surface arranged to rest and press on the top of a container inserted into the box, causing a substantially semiarch-shaped edge of an aperture provided in a portion of said upper elongate flap to simultaneously project towards the interior of the box, such that a cylindrical upper lateral surface of a container inserted into the box is securely retained laterally by said substantially semiarch-shaped edges of the upper elongate flags and at the same time is pressed by said upper elongate flaps towards and against the support for a base of the container, wherein each of said upper elongate flaps is divided into eight separate consecutive flap portions separated from each other by parallel folding lines, in first two flap portions closest to that side wall of the box from which they project there being provided a large profiled hole extending on both sides of the folding line which separates said first two flap portions from each other, an elongate aperture being provided in fourth and fifth flap portions on one and on the other side of the folding line which separates them, said aperture being bounded by said substantially semiarch-shaped edge which is provided in said fifth flap portion.

2. A display box for housing and retaining cylindrical containers with a portion of their lateral surface visible through a window provided in the box, comprising four side walls having lower ends and, respectively, upper ends from which there project a bottom lid and respectively a top lid, and upper and lower elongate flaps in which creasing lines are provided along which said upper and lower elongate flaps are folded with at least one portion thereof being in contact with and being glued onto the inner surface of the side wall from which each respective upper and lower flap projects, at least one of the lower elongate flaps forming for the container a support which is spaced from the bottom lid of the box, and wherein the upper elongate flaps are configured to form, for the top of the container, a pressing structure which is spaced from the top lid of the box, wherein each of the upper elongate flaps is configured to be folded and partly glued onto itself such as to lie substantially flat and coplanar with that side wall of the box from which it projects when said upper elongate flap is in its extended position with a portion thereof projecting from the upper end of the box but, by simply turning the upper elongate flap over towards the box interior, to undergo deformation and to automatically form a surface arranged to rest and press on the top of a container inserted into the box, causing a substantially semiarch-shaped edge of an aperture provided in a portion of said upper elongate flap to simultaneously project towards the interior of the box, such that a cylindrical upper lateral surface of a container inserted into the box is securely retained laterally by said substantially semiarch-shaped edges of the upper elongate flaps and at the same time is pressed by said upper elongate flaps towards and against the support for a base of the container, wherein each of said upper elongate flaps is divided into first to eight separate consecutive flap portions starting from a creasing line and which are separated from each other by parallel folding lines, wherein a profile hole is provided in the fourth and fifth flap portions crossing a folding line that separates the fourth and fifth flap portions with the substantially semiarch-shaped portion being provided in the fifth flap portion, wherein the sixth flap portion is glued over the inner surface of the respective side wall from which the respective upper elongate flap projects, and wherein the seventh and eighth flap portions are folded and glued over the third and second flap portions, respectively.

* * * * *